US007263924B2

(12) United States Patent
Ioku

(10) Patent No.: US 7,263,924 B2
(45) Date of Patent: Sep. 4, 2007

(54) HYDRAULIC CIRCUIT AND ITS VALVE GEAR

(75) Inventor: Kensuke Ioku, Hyogo (JP)

(73) Assignee: Nabtesco Corporation, Tokyo (JP)

( * ) Notice: Subject to any disclaimer, the term of this patent is extended or adjusted under 35 U.S.C. 154(b) by 0 days.

(21) Appl. No.: 11/392,476

(22) Filed: Mar. 29, 2006

(65) Prior Publication Data

US 2006/0249016 A1 Nov. 9, 2006

(30) Foreign Application Priority Data

Mar. 31, 2005 (JP) ..... 2005-100745

(51) Int. Cl.
*F15B 11/00* (2006.01)
*F16K 17/00* (2006.01)

(52) U.S. Cl. ..... 91/447; 91/433; 137/596.13

(58) Field of Classification Search ..... 91/420, 91/433, 447, 466, 467; 60/426; 137/596.13
See application file for complete search history.

(56) References Cited

U.S. PATENT DOCUMENTS 3,472,261 A * 10/1969 Brannon ..... 91/420
3,892,165 A * 7/1975 Lioux ..... 91/420
3,974,742 A * 8/1976 Johnson ..... 91/420
5,018,935 A * 5/1991 Gage ..... 91/420
5,259,293 A * 11/1993 Brunner ..... 91/420
5,996,466 A * 12/1999 Heusser ..... 91/420
6,068,064 A * 5/2000 Bettin et al. ..... 91/452
6,220,027 B1 * 4/2001 Heusser ..... 91/446
6,779,542 B2 * 8/2004 Fiala et al. ..... 91/447

FOREIGN PATENT DOCUMENTS

JP 06-050302 A 2/1994

OTHER PUBLICATIONS

Patent Abstracts of Japan; English Translation of Abstract of Japanese Publ. No. 06-050302; Dated Feb. 22, 1994; (2 pages).

* cited by examiner

*Primary Examiner*—Thomas E. Lazo
(74) *Attorney, Agent, or Firm*—Osha Liang LLP

(57) ABSTRACT

To simplify a circuit structure and a path structure in a hydraulic circuit having a pilot check valve and an overload relief valve and to reduce the size of a gear. The hydraulic circuit includes a pump port; a tank port; a first actuator port; a second actuator port; a first supply and discharge port; a second supply and discharge port; a direction changing valve; a first pilot check valve; a second pilot check valve; a first pilot path; and a first overload relief valve. The direction changing valve has a neutral position to communicate the first supply and discharge port with the tank port. The first overload relief valve is arranged in parallel with the first pilot check valve and is arranged between the first supply and discharge port and the first actuator port.

4 Claims, 3 Drawing Sheets

HYDRAULIC CIRCUIT AND ITS VALVE GEAR

BACKGROUND OF THE INVENTION

1. Field of the Invention

The present invention relates to a hydraulic circuit having a direction changing valve that changes supply and discharge directions of hydraulic oil between a pump, a tank, and an actuator, a pilot check valve, and an overload relief valve, and its valve gear.

2. Description of the Related Art

Conventionally, a hydraulic circuit having a direction changing valve for changing supply and discharge directions of hydraulic oil between a pump, a tank, and an actuator, a pilot check valve arranged between the direction changing valve and the actuator, and an overload relief valve for discharging the excess hydraulic oil; and its valve gear have been known (refer to Patent document 1). In the hydraulic circuit and the valve gear described in this Patent document 1, the pilot check valve (a lock valve mechanism v in Patent document 1) and the overload relief valve (a relief valve 40 in Patent document 1) are communicated with the pump and the tank through the paths that are separately provided.

Patent document 1: JP-A-6-50302

However, in the hydraulic circuit and the valve gear described in Patent document 1, as described above, it is necessary that the pilot check valve and the overload relief valve are communicated with the pump and the tank through the separate paths. Therefore, this involves a problem such that the circuit structure is complicated as the hydraulic circuit and the structure of the path formed in the valve gear is complicated. As a result, the valve gear itself becomes enlarged.

SUMMARY OF THE INVENTION

The present invention has been made taking the foregoing problems into consideration and the object of the invention is to provide a simple circuit structure and a simple path structure and a compact valve gear in a hydraulic circuit having a pilot check valve and an overload relief valve and its valve gear.

The present invention relates to a hydraulic circuit including a pump port that is communicated with a pump; a tank port that is communicated with a tank; a first actuator port and a second actuator port that are communicated with an actuator; a first supply and discharge port that is communicated with the first actuator port and a second supply and discharge port that is communicated with the second actuator port; a direction changing valve that is arranged between the pump port and the tank port and between the first supply and discharge port and the second supply and discharge port, and changes a supply and discharge direction of a hydraulic oil between the pump, the tank, and the actuator; a first pilot check valve that is arranged between the first supply and discharge port and the first actuator port; a first pilot path that activates the pressure of the hydraulic oil from the second supply and discharge port on the first pilot check valve as the pilot pressure; and a first overload relief valve that discharge the excess amount of the hydraulic oil in the first actuator port.

Then, the hydraulic circuit according to the present invention has the following some aspects in order to attain the above-described object. In other words, the hydraulic circuit of the present invention is provided with the following aspect independently or appropriately being combined.

In order to attain the object, according to a first aspect of the hydraulic circuit of the invention, the direction changing valve has a neutral position to communicate the first supply and discharge port with the tank port; and the first overload relief valve is arranged in parallel with the first pilot check valve and is arranged between the first supply and discharge port and the first actuator port.

According to this structure, the first overload relief valve and the first pilot check valve are arranged in parallel between the supply and discharge port and the first actual port. Therefore, when the first overload relief valve is opened and the excess hydraulic oil in the first actuator port is discharged, the first overload relief valve is communicated with the tank port through the first supply and discharge port in the same way as the first pilot check valve. Accordingly, in the hydraulic circuit having the pilot check valve and the overload relief valve, the circuit structure and the path structure can be simplified and the valve gear can be made compact depending on this hydraulic circuit.

In addition, the hydraulic circuit of a second aspect according to the invention may further comprise a second pilot check valve that is arranged between the second supply and discharge port and the second actuator port; a second pilot path that activates the pressure of the hydraulic oil from the first supply and discharge port on the second pilot check valve as the pilot pressure; and a second overload relief valve that discharge the excess amount of the hydraulic oil in the second actuator port; wherein the neutral position of the direction changing valve further communicates the second supply and discharge port with the tank port; and the second overload relief valve is arranged in parallel with the second pilot check valve and is arranged between the second supply and discharge port and the second actuator port.

According to this structure, the second overload relief valve and the second pilot check valve are arranged in parallel between the supply and discharge port and the second actuator port. Therefore, when the second overload relief valve is opened and the excess hydraulic oil in the second actuator port is discharged, the second overload relief valve is communicated with the tank port through the second supply and discharge port in the same way as the second pilot check valve. Accordingly, in the hydraulic circuit having the pilot check valve and the overload relief valve, the circuit structure and the path structure can be simplified and the valve gear can be made compact depending on this hydraulic circuit. Further, in the hydraulic circuit to prevent leakage of the hydraulic oil from the actuator using the pilot check valve, it is possible to prevent the structure of this hydraulic circuit from being complicated.

In addition, according to a third aspect of the hydraulic circuit according to the invention, the first overload relief valve serves as first valve opening means that opens the first pilot check valve when the pressure of the hydraulic oil from the first actuator port exceeds a predetermined relief pressure.

According to this structure, when the pressure of the first actuator port exceeds a predetermined relief pressure, the first overload relief valve becomes means for opening the first pilot check valve, so that the first pilot check valve is operated in cooperation with the operation of the first overload relief valve. Therefore, as the first pilot check valve to interrupt a space between the first actuator port and the first supply and discharge port, a function of the overload relief valve that is operated in cooperation with the first overload relief valve can be also used. Thereby, the circuit structure of the hydraulic circuit can be simplified. In addition, in the first overload relief valve and the first pilot check valve, a path can be shared, and this makes it possible to simplify the structure of the path in the hydraulic circuit.

In addition, the invention relates to a valve gear including a main body on which a pump port communicated with a pump; a tank port communicated with a tank; a first actuator port and a second actuator port communicated with an actuator; and a first supply and discharge port that is communicated with the first actuator port and a second supply and discharge port that is communicated with the second actuator port are formed; a direction changing valve that is arranged in the main body between the pump port and the tank port and between the first supply and discharge port and the second supply and discharge port, and changes a supply and discharge direction of a hydraulic oil between the pump, the tank, and the actuator; a first path formed on the main body so as to communicate the first supply and discharge port with the first actuator port; a first main valve that is arranged so as to be capable of communicating and interrupting the first path; a first back pressure chamber that is formed on the first main valve; a first throttle that is formed on the first main valve and communicates the first back pressure chamber with the first actuator port; a first through hole that is formed on the first main valve and communicates the first back pressure chamber with the first supply and discharge port; a first child valve for check that is arranged so as to be capable of communicating and interrupting the first through hole; a first spring for check that biases the first child valve for check toward a direction to interrupt the first through hole; and a piston that is arranged being capable of pressing the first child valve for check in a valve opening direction so as to be communicated with the first through hole by activation of the pressure of the hydraulic oil in the second supply and discharge port.

Then, in order to attain the object, the valve gear according to the invention has some aspects as follows. In other words, the invention has the following aspects independently or has the appropriate combination thereof.

In order to attain the object, the valve gear of a first aspect according to the invention may further comprise a first child valve for relief that is arranged so as to be capable of communicating and interrupting the space between the first back pressure chamber and the tank port; and a first spring for relief that is arranged to be stretched against the pressure of the hydraulic oil from the first actuator port so as to bias the first child valve for relief in a direction interrupting the space between the first back pressure chamber and the tank port; wherein, when the pressure of the hydraulic oil from the first actuator port exceeds a predetermined relief pressure, due to the activation of the pressure of the hydraulic oil from the first actuator port, the first child valve for relief is opened against the bias force of the first spring for relief so as to lower the pressure of the hydraulic oil in the first back pressure chamber, and the first main valve is opened so as to be communicated with the first path.

According to this structure, the first main valve can be shared as the main valve for the overload relief valve and the main valve for the pilot check valve. Thereby, the number of components can be reduced and the circuit structure in the valve gear can be simplified. In addition, since the path communicated from the overload relief valve to the first actuator port and the path communicated from the pilot check valve to the first actuator port can be shared, the path structure of the valve gear can be simplified and the valve gear can be made compact.

According to a second aspect of the valve gear according to the invention, the first child valve for relief and the first child valve for check are arranged so that their operational directions are located on the same axis.

According to this structure, since the first child valve for relief and the first child valve for check can be arranged within the same straight hole, the number of processing of the hold in the valve gear can be reduced. In addition, when the pilot check valve and the overload relief valve are provided in the valve gear such as a construction machine, it is very difficult to arrange these two valves in one block, and this leads to enlargement of the valve gear. However, by arranging the first child valve for relief and the first child valve for check so that its operational directions are located on the same axis, in a space substantially the same as that where any one of the pilot check valve and the overload relief valve is arranged, both of the pilot check valve and the overload relief valve and this makes it possible to prevent enlargement of the valve gear.

In addition, the valve gear of a third aspect according to the invention may further comprise a second path formed on the main body so as to communicate the second supply and discharge port with the second actuator port; a second main valve that is arranged so as to be capable of communicating and interrupting the second path; a second back pressure chamber that is formed on the second main valve; a second throttle that is formed on the second main valve and communicates the second back pressure chamber with the second actuator port; a second through hole that is formed on the second main valve and communicates the second back pressure chamber with the second supply and discharge port; a second child valve for check that is arranged so as to be capable of communicating and interrupting the second through hole; a second spring for check that biases the second child valve for check toward a direction to interrupt the second through hole; a piston that is arranged being capable of pressing the second child valve for check in a valve opening direction so as to be communicated with the second through hole by activation of the pressure of the hydraulic oil in the first supply and discharge port; a second child valve for relief that is arranged so as to be capable of communicating and interrupting the space between the second back pressure chamber and the tank port; and a second spring for relief that is arranged to be stretched against the pressure of the hydraulic oil from the second actuator port so as to bias the second child valve for relief in a direction interrupting the space between the second back pressure chamber and the tank port; wherein the second child valve for relief and the second child valve for check are arranged so that their operational directions are located on the same axis as the operational direction of the first child valve for relief, and when the pressure of the hydraulic oil from the second actuator port exceeds a predetermined relief pressure, due to the activation of the pressure of the hydraulic oil from the second actuator port, the second child valve for relief is opened against the bias force of the second spring for relief so as to lower the pressure of the hydraulic oil in the second back pressure chamber, and the second main valve is opened so as to be communicated with the second path.

According to this structure, since the first child valve for relief, the first child valve for check, the second child valve for relief, and the second child valve for check can be arranged in the same straight hole, it is possible to reduce the number of processing in the hold of the valve gear.

DESCRIPTION OF THE PREFERRED EMBODIMENT(S)

The preferred embodiment(s) of the invention will be described below with reference to the drawings. The invention can be applied widely relating to a hydraulic circuit having a direction changing valve that changes supply and discharge directions of hydraulic oil between a pump, a tank, and an actuator, a pilot check valve, and an overload relief valve, and its valve gear. For example, the invention can be used as the hydraulic circuit and its valve gear provided to the construction machine, however, the usage of the invention is not limited to this and can be applied to a broader usage and the invention can be applied to may different environments and various purposes. Further, the embodiments of the hydraulic circuit will be described divided into a first embodiment and a second embodiment. Then, the embodiments of the valve gear will be described.

First Embodiment of the Hydraulic Circuit

Figure 1:
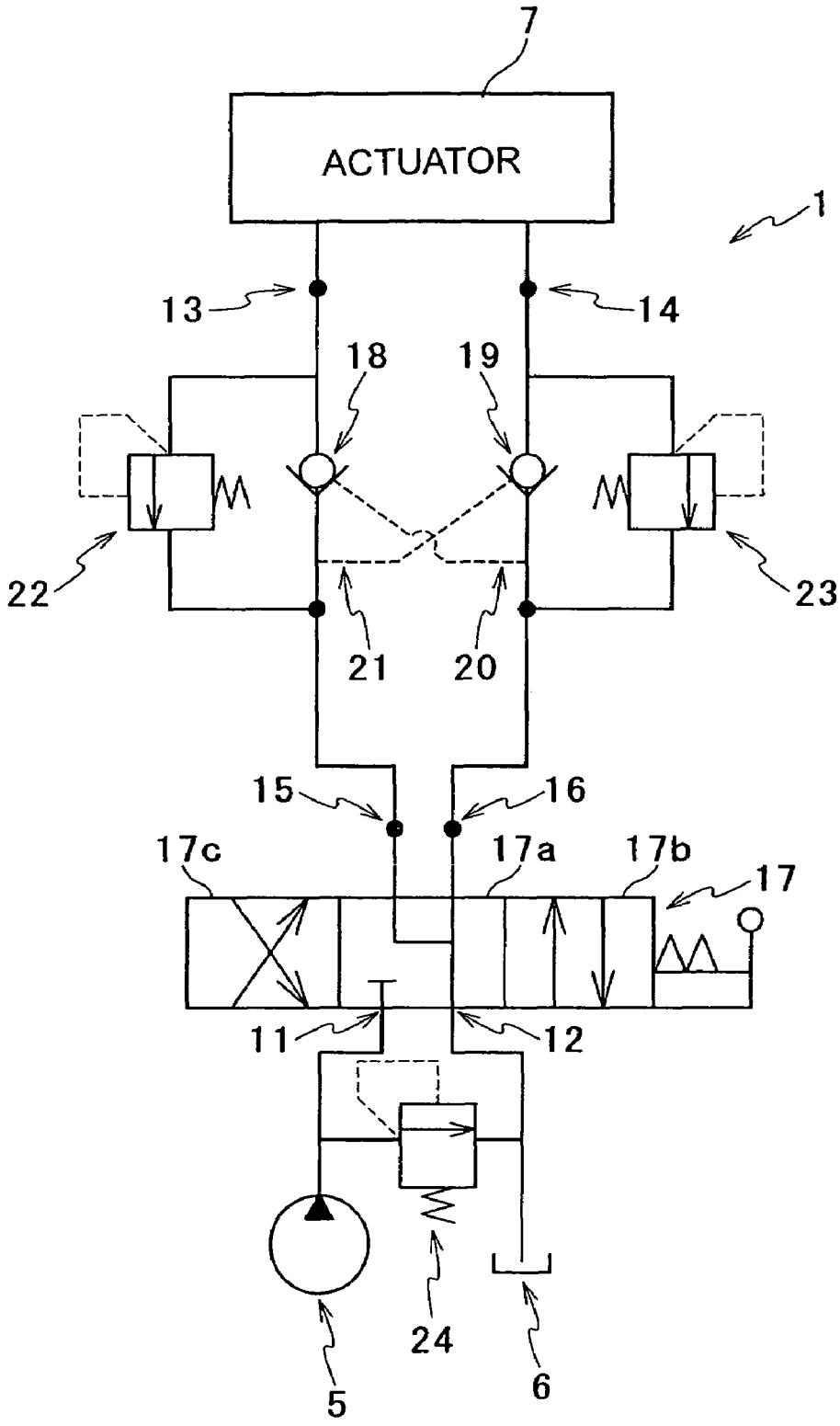
FIG. 1 is a circuit diagram illustrating a hydraulic circuit according to a first embodiment of the invention.

FIG. 1 shows a hydraulic circuit according to a first embodiment of the invention. For example, this hydraulic circuit 1 is used as that for driving various actuators in a construction machine or the like. Then, this hydraulic circuit 1 is connected to a pump 5, a tank 6, and an actuator 7, and this hydraulic circuit 1 is configured as a hydraulic circuit which returns the hydraulic oil supplied from the pump 5 to the tank 6 via the actuator 7 and circulates the hydraulic oil to control the operation of the actuator 7.

This hydraulic circuit 1 is provided with various ports such as a pump port 11, a tank port 12, a first actuator port 13, a second actuator port 14, a first supply and discharge port 15, and a second supply and discharge port 16. The pump port 11 is connected to the pump 5 so as to be communicated therewith, and the tank port 12 is connected to the tank 6 so as to be communicated therewith. In addition, the first actuator port 13 and the second actuator port 14 are connected to the actuator 7 so as to be communicated therewith. Then, the first supply and discharge port 15 is communicated with the first actuator port 13 and the second supply and discharge port 16 is communicated with the second actuator port 14.

In addition, in the hydraulic circuit 1, a direction changing valve 17, a first pilot check valve 18, a second pilot check valve 19, a first pilot path 20, a second pilot path 21, a first overload relief valve 22, and a second overload relief 23 or the like are provided.

The direction changing valve 17 is arranged between the pump port 11 and the tank port 12 and between the first supply and discharge port 15 and the second supply and discharge port 16. This direction changing valve 17 has a neutral position 17*a* and two changing positions 17*b* and 17*c*, and the changing operations at these positions are carried out so as to change the supply and discharge directions of the hydraulic oil between the pump 5, the tank 6, and the actuator 7. Further, when the direction changing valve 17 is located at the neutral position 17*a*, the first and second supply and discharge ports (15, 16) and the tank port 12 are connected so that the first supply and discharge port 15 is communicated with the tank port 12 and the second supply and discharge port 16 is communicated with the tank port 12.

The first pilot check valve 18 is arranged between the first supply and discharge port 15 and the first actuator port 13 and the first pilot check valve 18 is provided as a valve having a check valve function to make the flow of the hydraulic oil from the first supply and discharge port 15 to the first actuator port 13 into the forward direction. On the other hand, the second pilot check valve 19 is arranged between the second supply and discharge port 16 and the second actuator port 14 and this second pilot check valve 19 is configured as a valve having a check valve function to make the flow of the hydraulic oil from the second supply and discharge port 16 to the second actuator port 14 into the forwarding direction.

The first pilot path 20 is provided so that the first pilot check valve 18 makes the pressure of the hydraulic oil from the second supply and discharge port 16 to be operated as the pilot pressure. On the other hand, the second pilot path 21 is provided so that the second pilot check valve 19 makes the pressure of the hydraulic oil from the first supply and discharge port 15 to be operated as the pilot pressure.

The first overload relief valve 22 may discharge the excess amount of the hydraulic oil (the excess hydraulic oil) in the first actuator port 13, and this first overload relief valve 22 is provided as a relief valve to encourage discharge of the hydraulic oil from this first actuator port 13 when the pressure of the hydraulic oil from the first actuator port 13 is high. This first overload relief valve 22 is arranged in parallel with the first pilot check valve 18 and is arranged between the first supply and discharge port 15 and the first actuator port 13. Further, the first overload relief valve 22 is connected to the first actuator port 13 so as to be communicated therewith and is connected to the first supply and discharge port 15 so as to be communicated therewith, and when the hydraulic oil from the first actuator port 13 exceeds a predetermined relief pressure, the first overload relief valve 22 may flow the excess hydraulic oil in the first actuator port 13 to the first supply and discharge port 15.

The second overload relief valve 23 may discharge the excess amount of the hydraulic oil (the excess hydraulic oil) in the second actuator port 14, and this second overload relief valve 23 is provided as a relief valve to encourage discharge of the hydraulic oil from this second actuator port 14 when the pressure of the hydraulic oil from the second actuator port 14 is high. This second overload relief valve 23 is arranged in parallel with the second pilot check valve 19 and is arranged between the second supply and discharge port 16 and the second actuator port 14. Further, the second overload relief valve 23 is connected to the second actuator port 14 so as to be communicated therewith and is connected to the second supply and discharge port 16 so as to be communicated therewith, and when the hydraulic oil from the second actuator port 14 exceeds a predetermined relief pressure, the second overload relief valve 23 may flow the excess hydraulic oil in the second actuator port 14 to the second supply and discharge port 16.

Next, the operation of the hydraulic circuit 1 provided with the above-described structure will be described. As shown in FIG. 1, the hydraulic oil from the pump 5 is not supplied to the actuator 7 and it is supplied to the tank 6 via the relief valve 24 with the direction changing valve 17 located at the neutral position 17*a*. In addition, since the first supply and discharge port 15 and the second supply and discharge port 16 are communicated with the tank port 12, the hydraulic oil will be discharged to the tank 6.

When the direction changing valve 17 is changed from the state shown in FIG. 1 into the changing position 17*b*, the hydraulic oil from the pump 5 is supplied from the pump port 11 into the first supply and discharge port 15. Further, operating the first pilot check valve 18 in the forwarding direction, the hydraulic oil is supplied to the actuator 7 via the first actuator port 13. Then, the actuator 7 is operated due to the hydraulic oil from the first actuator port 13, and the hydraulic oil is discharged to the second actuator port 14 from the actuator 7.

In this case, the pressure of the hydraulic oil from the first supply and discharge port 15 is operated on the second pilot check valve 19 via the second pilot path 21 as the pilot pressure. Therefore, the second pilot check valve 19 is operated in a valve opening direction, and the hydraulic oil discharged from the actuator 7 to the second actuator port 14 is supplied to the second supply and discharge port 16 through the second pilot check valve 19. Then, further, the hydraulic oil is returned from the second supply and discharge port 16 to the tank 6 via the tank port 12.

Further, when the pressure of the hydraulic oil from the second actuator port 14 becomes higher and it exceeds a predetermined relief pressure, the second overload relief valve 23 is operated. Thereby, the hydraulic oil from the second actuator port 14 will be discharged to the second supply and discharge port 16 via the second overload relief valve 23 that is arranged in parallel with the second pilot check valve 19.

On the other hand, when the direction changing valve 17 is changed from the state shown in FIG. 1 into the changing position 17*c*, the hydraulic oil from the pump 5 is supplied from the pump port 11 into the second supply and discharge port 16. Further, operating the second pilot check valve 19 in the forwarding direction, the hydraulic oil is supplied to the actuator 7 via the second actuator port 14. Thereby, the actuator 7 is operated due to the hydraulic oil from the second actuator port 14 in a direction opposite to the case that the direction changing valve 17 is changed into the changing position 17*b*. Then, the hydraulic oil will be discharged from the actuator 7 to the first actuator port 13.

In this case, the pressure of the hydraulic oil from the second supply and discharge port 16 is operated on the first pilot check valve 18 through the first pilot path 20 as a pilot pressure. Therefore, the first pilot check valve 18 is operated in the valve opening direction, and the hydraulic oil discharged from the actuator 7 to the first actuator port 13 will be supplied to the first supply and discharge port 15 through the first pilot check valve 18. Then, the hydraulic oil is further returned from the first supply and discharge port 15 to the tank 6 via the tank port 12.

Further, when the pressure of the hydraulic oil from the first actuator port 13 becomes higher and it exceeds a predetermined relief pressure, the first overload relief valve 22 is operated. Thereby, the hydraulic oil will be discharged to the first supply and discharge port 15 via the first overload relief valve 22 that is arranged in parallel with the first pilot check valve 18.

In the first hydraulic circuit 1 according to the above-described first embodiment, the first overload relief valve 22 and the first pilot check valve 18 are arranged in parallel between the first supply and discharge port 15 and the first actuator port 13. Therefore, when the first overload relief valve 22 is opened to discharge the excess hydraulic oil in the first actuator port 13, the first overload relief valve 22 will be communicated with the tank port 12 via the first supply and discharge port 15 as same as the first pilot check valve 18.

In addition, in the hydraulic circuit 1, the second overload relief 23 and the second pilot check valve 19 are arranged in parallel between the second supply and discharge port 16 and the second actuator port 14. Therefore, when the second overload relief valve 23 is opened to discharge the excess hydraulic oil in the second actuator port 14, the second overload relief valve 23 will be communicated with the tank port 12 via the second supply and discharge port 16 as same as the second pilot check valve 19.

Accordingly, due to the hydraulic circuit 1 having the pilot check valve and the overload relief valve, the circuit structure and the path structure can be simplified and the valve gear depending on the hydraulic circuit can be made compact. In addition, due to the hydraulic circuit 1 preventing leakage of the hydraulic oil from the actuator using the pilot check valve, it is possible to prevent the hydraulic circuit from being complicated.

Second Embodiment of a Hydraulic Oil Circuit

Figure 2:
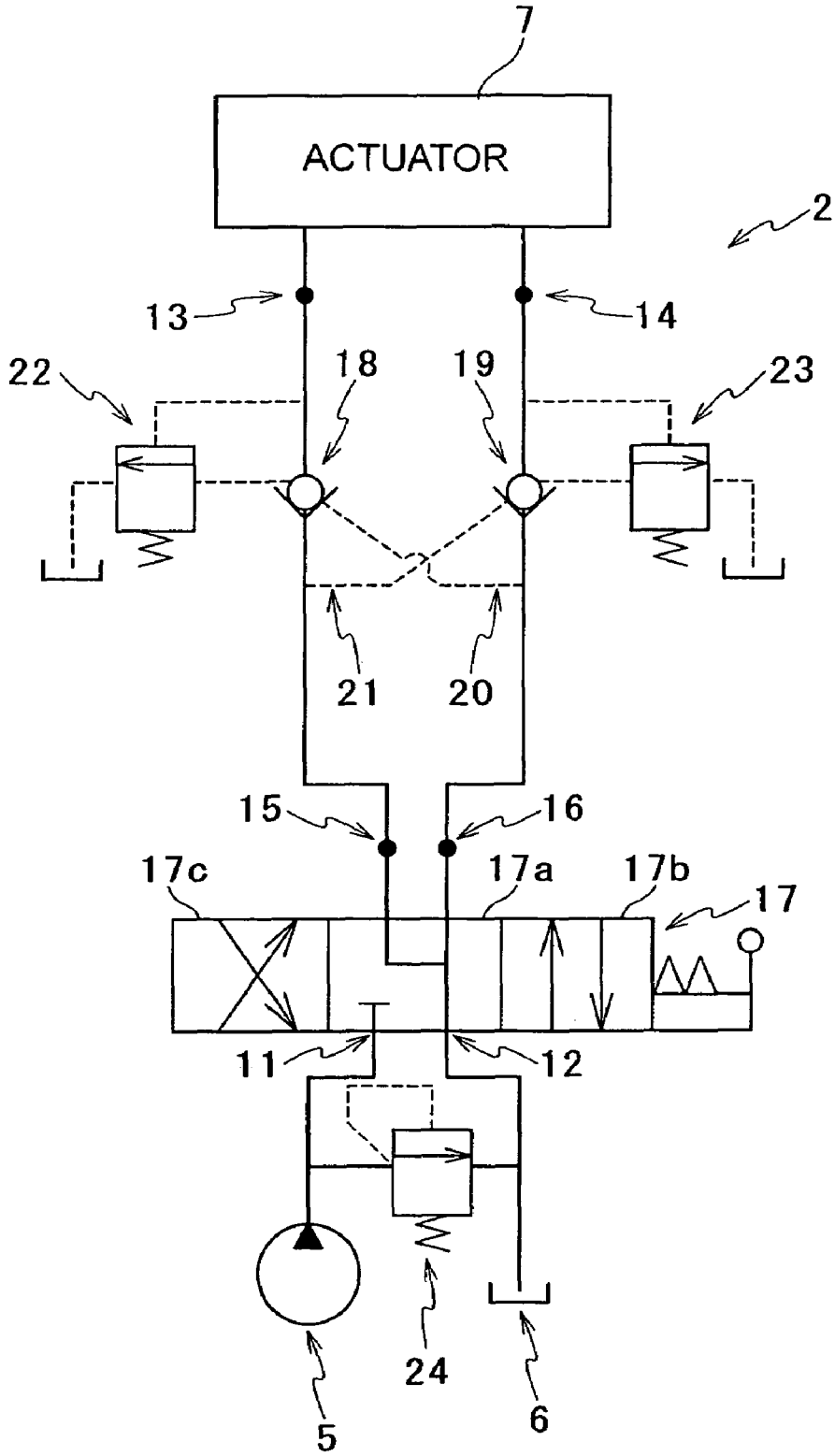
FIG. 2 is a circuit diagram illustrating a hydraulic circuit according to a second embodiment of the invention.

FIG. 2 shows a hydraulic circuit according to a second embodiment of the invention. As same as the hydraulic circuit 1 of the first embodiment, this hydraulic circuit 2 is also used as a hydraulic circuit to drive various actuators in a construction machine or the like as same as the hydraulic circuit 1 of the first embodiment. Then, this hydraulic circuit 2 is also connected to the pump 5, the tank 6, and the actuator 7, and this hydraulic circuit 2 is configured as a hydraulic circuit which returns the hydraulic oil supplied from the pump 5 to the tank 6 via the actuator 7 and circulates the hydraulic oil to control the operation of the actuator 7.

This hydraulic circuit 2 is also provided with the pump port 11, the tank port 12, the first actuator port 13, the second actuator port 14, the first supply and discharge port 15, the second supply and discharge port 16, the direction changing valve 17, the first pilot check valve 18, the second pilot check valve 19, the first pilot path 20, and the second pilot path 21 as same as the hydraulic circuit 1. However, the hydraulic circuit 2 is partially different from the hydraulic circuit 1 in the structures of a first overload relief valve 31 and a second overload relief valve 32.

The first overload relief valve 31 to discharge the excess amount of the hydraulic oil (the excess hydraulic oil) in the first actuator port 13 is arranged in parallel with the first pilot check valve 18 as same as the first overload relief valve 22 of the first hydraulic circuit 1, and the first overload relief valve 31 is arranged between the first supply and discharge port 15 and the first actuator port 13. However, this first overload relief valve 31 is connected to the tank 6 at the downstream side, and the first overload relief valve 31 is configured as the first opening means to open the first pilot check valve 18 when the pressure of the hydraulic oil from the first actuator port 13 exceeds a predetermined relief pressure. In other words, when the pressure of the hydraulic oil from the first actuator port 13 exceeds a predetermined relief pressure and the first overload relief valve 31 is operated, the hydraulic oil activated on the first pilot check valve 18 will be discharged to the tank 6 via the first overload relief valve 31. Further, when the first pilot check valve 18 is opened, the hydraulic oil will be discharged to the tank 6 through the first supply and discharge port 15 and the tank port 12 even via the first pilot check valve 18.

In addition, the second overload relief valve 32 discharging the excess amount of the hydraulic oil (the excess hydraulic oil) in the second actuator port 14 is arranged in parallel with the second pilot check valve 19 as same as the second overload relief valve 23 of the hydraulic circuit 1, and the second overload relief valve 32 is arranged between the second supply and discharge port 16 and the second actuator port 14. However, this second overload relief valve 32 is connected to the tank 6 at its downstream side, and the second overload relief valve 32 is configured as the second means of opening a valve that opens the second pilot check valve 19 when the pressure of the hydraulic oil from the second actuator port 14 exceeds a predetermined relief pressure. In other words, when he pressure of the hydraulic oil from the second actuator port 14 exceeds a predetermined relief pressure and the second overload relief valve 32 is operated, the hydraulic oil that is activated on the second pilot check valve 19 is discharged via the second overload relief valve 32 to the tank 6. Then, further, by opening the second pilot check valve 19, the hydraulic oil is discharged to the tank 6 through the second supply and discharge port 16 and the tank port 12 via the second pilot check valve 19.

In this hydraulic circuit 2, the same effect as the hydraulic circuit 1 can be effected. Then, due to this hydraulic circuit 2, the first overload relief valve 31 serves as the means of opening the first pilot check valve 18 when the pressure of the first actuator port 13 exceeds a predetermined relief pressure, so that the first pilot check valve 18 is also operated in cooperation with the first overload relief valve 31. Therefore, it is possible to use the first pilot check valve 18 to interrupt the space between the first actuator port 13 and the first supply and discharge port 15 as a function of the overload relief valve that is operated in corporation with the first overload relief valve 31.

In addition, the second overload relief valve 32 has the same effect as the first overload relief valve 31. In other words, it is possible to use the second pilot check valve 19 to interrupt the space between the second actuator port 14 and the second supply and discharge port 16 as a function of the overload relief valve operated in corporation with the second overload relief valve 32.

Thereby, also in the hydraulic circuit 2, it is possible to simplify the circuit structure of the hydraulic circuit. In addition, it is possible to standardize the path in the first overload relief valve 31 and the first pilot check valve 18 and it is also possible to standardize the path in the second overload relief valve 32 and the second pilot check valve 19. Therefore, it is also possible to simplify the structure of the path in the hydraulic circuit.

Embodiment of Valve Gear

Figure 3:
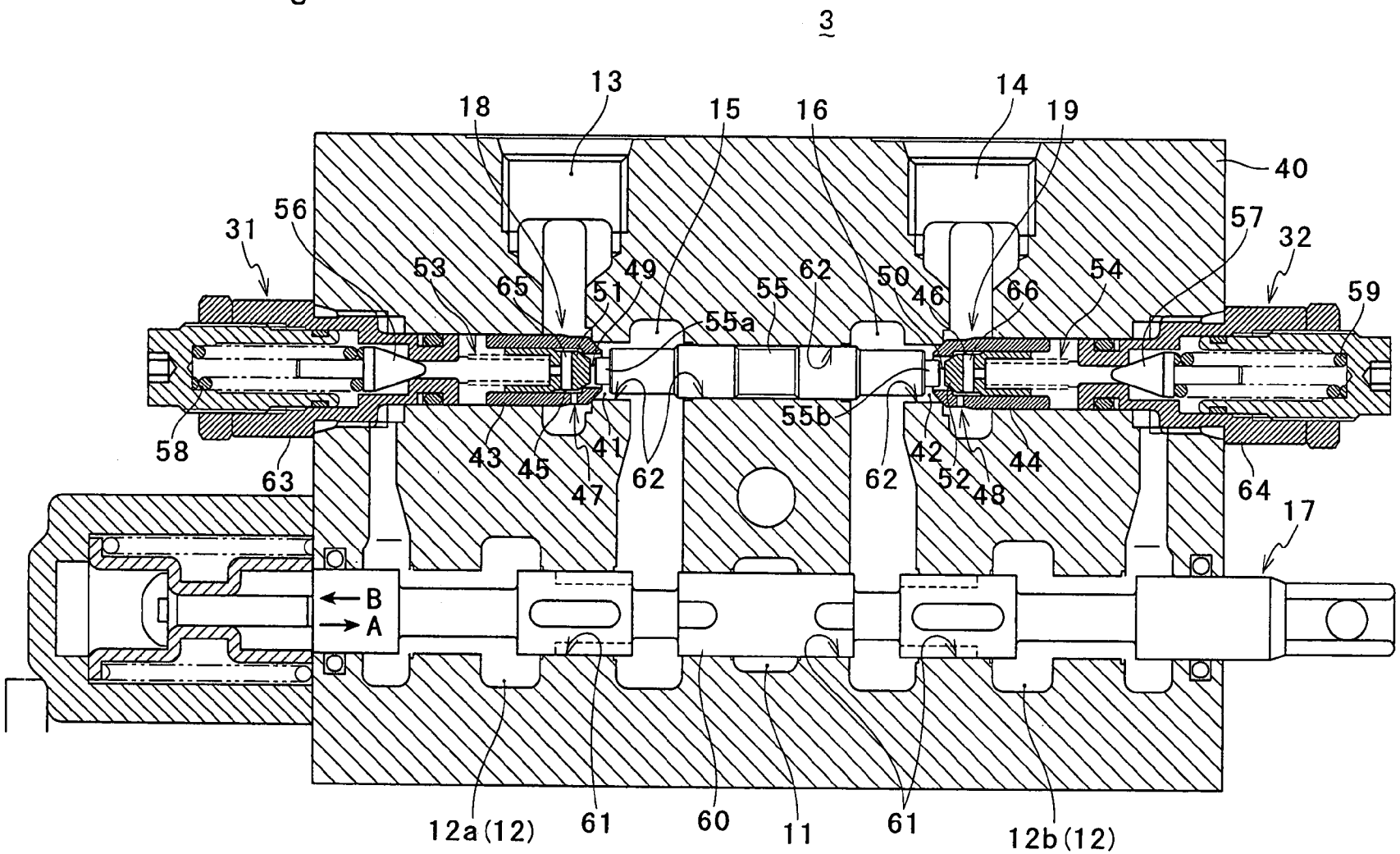
FIG. 3 is a sectional view showing a valve gear according to the embodiment of the invention.

Next, the embodiment of the valve gear will be described. FIG. 3 is a sectional view of a valve gear 3 according to the embodiment of the present invention. The valve gear 3 shown in FIG. 3 relates to the embodiment that is an example of the valve gear corresponding to the hydraulic circuit 2.

The valve gear 3 shown in FIG. 3 is connected to the pump 5, the tank 6, and the actuator 7 (refer to FIG. 2) and the valve gear 3 is configures as a valve gear that returns the hydraulic oil supplied from the pump 5 to the tank 6 via the actuator 7 and controls the operation of the actuator 7. Then, the valve gear 3 is provided with a main body 40 that is formed in the shape of a block. In the following description, the elements common to those of the hydraulic circuit 2 shown in FIG. 2 will be given the same reference numerals.

On the main body 40 of the valve gear 3, the pump port 11, the tank port 12 (12*a*, 12*b*), the first actuator port 13, the second actuator port 14, the first supply and discharge port 15, and the second supply and discharge port 16 are formed. The pump port 11 is connected to the pump 5 so as to be communicated therewith, and the tank ports 12*a* and 12*b* are connected to the tank 6 so as to be communicated therewith, respectively. In addition, the first actuator port 13 and the second actuator port 14 are connected to the actuator 7 so as to be communicated therewith, respectively. Then, the first supply and discharge port 15 is communicated with the first actuator port 13 and the second supply and discharge port 16 is communicated with the second actuator port 14.

In addition, the valve gear 3 is provided with the direction changing valve 17, the first pilot check valve 18, the second pilot check valve 19 that are shown in FIG. 2, the first overload relief valve 31, and the second overload relief valve 32. These respective valves are provided as the valves to perform the same functions as respective valves given the same reference numerals in FIG. 2. In addition, the valve gear 3 is also provided with a hole for a path 62 and a piston 55 arranged in this hole for a path 62.

The hole for a path 62 is formed as a hole in which the first pilot check valve 18, the second pilot check valve 19, the first overload relief valve 31, and the second overload relief valve 32 are arranged. Then, a part of this hole for a path 62 configures a first path 41 that is formed so as to communicate the first supply and discharge port 15 with the first actuator port 13. In addition, the other part of the hole for a path 62 configures the second path 42 that is formed so as to communicate the second supply and discharge port 16 with the second actuator port 14.

The direction changing valve 17 is configured to be provided with a spool 60 and a spool hole 61, and the direction changing valve 17 is arranged between the pump port 11, the tank port 12 (12*a*, 12*b*), the first supply and discharge port 15, and the second supply and discharge port 16 in the main body 40 so as to change the direction of supplying and discharging of the hydraulic oil between the pump 5, the tank 6, and the actuator 7 (refer to FIG. 2). Further, FIG. 3 shows the state that the direction changing valve 17 is located at the neutral position 17*a* (refer to FIG. 2). At this neutral position 17*a*, the first supply and discharge port 15 is communicated with the tank port 12*a* and the second supply and discharge port 16 is communicated with the tank port 12*b* via a notch part formed in the spool 60.

In the hole for a path 62, the first pilot check valve 18 arranged between the first supply and discharge port 15 and the first actuator port 13 is provided with the a first main valve 43, a first child valve for check 51, and a first spring for check 53. The first main valve 43 is arranged so as to be capable of communicating and interrupting the first path 41. Then, on this first main valve 43, a first back pressure chamber 45, a first throttle 47, and a first through hole 49 are formed. The first back pressure chamber 45 is provided as a hollow of the first main valve 43. The first throttle 47 is provided as a hole for communicating the first back pressure chamber 45 with the first actuator port 13. A first through hole 49 is provided as a through hole to communicate the first back pressure chamber 45 with the first supply and discharge port 15. Further, the first main valve 43 is formed so that the pressure receiving area of the side of the first actuator port 13 (the side opposed to the first supply and discharge port 15) is smaller than that of the side of the first back pressure chamber 45 (the side opposed to the first overload relief valve 31).

The first child valve for check 51 of the first pilot check valve 18 is arranged in the first back pressure chamber 45 being inserted in the hollow of the first main valve 43. Then, this first child valve for check 51 is arranged so as to be capable of communicating and interrupting the first through hole 49. Further, on the first child valve for check 51, a first communicating path 65 is formed. In addition, the first spring for check 53 of the first pilot check valve 18 is arranged to bias the first child valve for check 51 toward the direction interrupting the first through hole 49.

In addition, in the hole for a path 62, the second pilot check valve 19 arranged between the second supply and discharge port 16 and the second actuator port 14 is provided with a second main valve 44, a second child valve for check 52, and a second spring for check 54. The second main valve 44 is arranged so as to be capable of communicating and interrupting the second path 42. Then, on this second main valve 44, a second back pressure chamber 46, a second throttle 48, and a second through hole 50 are formed. The second back pressure chamber 46 is provided as a hollow of the second main valve 44. The second throttle 48 is provided as a hole to communicate the second back pressure chamber 46 with the second actuator port 14. The second through hole 50 is provided as a through hole to communicate the second back pressure chamber 46 with the second supply and discharge port 16. Further, the second main valve 44 is formed so that the pressure receiving area of the side of the second actuator port 14 (the side opposed to the second supply and discharge port 16) is smaller than that of the side of the second back pressure chamber 46 (the side opposed to the second overload relief valve 32).

A second child valve for check 52 of the second pilot check valve 19 is arranged in the second back pressure chamber 46 being inserted in the hollow of the second main valve 44.

Then, this second child valve for check 52 is arranged so as to be capable of communicating and interrupting the second through hole 50. Further, on the second child valve for check 52, a second communicating path 66 is formed. In addition, the second spring for check 54 of the second pilot check valve 19 is arranged to bias the second child valve for check 52 toward the direction interrupting the second through hole 50.

In addition, in a piston 55 slidably arranged in the hole for a path 62, a first protrusion part 55*a* is formed at one end opposed to the first pilot check valve 18, and a second protrusion part 55*b* is formed at the other end opposed to the second pilot check valve 19.

When the piston 55 moves toward the first pilot check valve 18, the first protrusion part 55*a* of the piston 55 can abut against the first child valve for check 51 through the first through hole 49. In other words, the piston 55 moves toward the first pilot check valve 18 by activating the hydraulic oil in the second supply and discharge port 16 on the other end (the end at the side where the second protrusion part 55*b* is disposed) and the piston 55 is arranged being capable of pressing the first child valve for check 51 in a direction of opening the valve so as to be communicated with the first through hole 49.

On the other hand, when the piston 55 moves toward the second pilot check valve 19, the second protrusion part 55*b* of the piston 55 can abut against the second child valve for check 52 through the second through hole 50. In other words, the piston 55 moves toward the second pilot check valve 19 by activating the hydraulic oil in the first supply and discharge port 15 on the other end (the end at the side where the first protrusion part 55*a* is disposed) and the piston 55 is arranged being capable of pressing the second child valve for check 52 in a direction of opening the valve so as to be communicated with the second through hole 50.

Further, by arranging the piston 55 in the hole for a path 62, the functions of the first pilot path 20 and the second pilot path 21 in the hydraulic circuit 2 shown in FIG. 2 are carried out by the hole for a path 62.

The first overload relief valve 31 to discharge the excess hydraulic oil in the first actuator port 13 is provided with a first child valve for relief 56, a first spring for relief 58, and a first support unit 63. The first support unit 63 is formed being provided with a hollow and a hole capable of communicating the hole for a path 62 with the tank port 12*a*. In addition, the first spring for check 53 is pressed against the end within the hole for a path 62 of the first support unit 63.

The first child valve for relief 56 of the first overload relief valve 31 is arranged in the hollow of the first support unit 63, and the first child valve for relief 56 is arranged so as to be capable of communicating and interrupting the space between the first back pressure chamber 45 of the first main valve 43 and the tank port 12*a*. The first spring for relief 58 of the first overload relief valve 31 is arranged in the hollow of the first support unit 63. Then, this first spring for relief 58 is arranged to be stretched against the pressure of the hydraulic oil acting from the first actuator port 13 through the hole for a path 62 so as to bias the first child valve for relief 56 in a direction interrupting the space between the first back pressure chamber 45 and the tank port 12*a*.

The second overload relief valve 32 to discharge the excess hydraulic oil in the second actuator port 14 is provided with a second child valve for relief 57, a second spring for relief 59, and a second support unit 64. The second support unit 64 is formed provided with a hollow capable of communicating the hole for a path 62 with the tank port 12*b*. In addition, the second spring for check 54 is pressed against the end within the hole for a path 62 of the second support unit 64.

The second child valve for relief 57 of the second overload relief valve 32 is arranged in the hollow of the second support unit 64, and the second child valve for relief 57 is arranged so as to be capable of communicating and interrupting the space between the second back pressure chamber 46 of the second main valve 44 and the tank port 12*b*. The second spring for relief 59 of the second overload relief valve 32 is arranged in the hollow of the second support unit 64. Then, this second spring for relief 59 is arranged and stretched against the pressure of the hydraulic oil acting from the second actuator port 14 through the hole for a path 62 so as to bias the second child valve for relief 57 in a direction interrupting the space between the second back pressure chamber 46 and the tank port 12*b*.

In addition, the first child valve for check 51 of the first pilot check valve 18 and the first child valve for relief 56 of the first overload relief valve 31 are arranged so that their operational directions are located on the same axis. Then, the second child valve for check 52 of the second pilot check valve 19 and the second child valve for relief 57 of the second overload relief valve 32 are arranged so that their operational directions are located on the same axis, and further are located on the same axis as the operational directions of the first child valve for relief 56 and the first child valve for check 51.

Next, the operation of the valve gear 3 that is configures as described above will be described. When the direction changing valve 17 is changed so that the spool 60 moves from the state shown in FIG. 3 (namely, the state that the direction changing valve 17 is located at the neutral position 17*a*) to the direction represented by an arrow A in FIG. 3, the pump port 11 is communicated with the first supply and discharge port 15 via a notch part and a groove formed in the spool 60, and the second supply and discharge port 16 is communicated with the tank port 12*b* (further, when the direction changing valve 17 is changed so that the spool 60 moves to the direction of the arrow A, the direction changing valve 17 is changed to the changing position 17*b* shown in FIG. 2). Thereby, the hydraulic oil supplied from the pump 5 to the pump port 11 is supplied to the first supply and discharge port 15.

The hydraulic oil supplied from the pump port 11 to the first supply and discharge port 15 biases the first main valve 43 against the bias force of the first spring for check 53 of the first pilot check valve 18 so as to open the first main valve 43 in the forward direction. Thereby, the hydraulic oil is supplied from the first supply and discharge port 15 to the first actuator port 13 via the first pilot check valve 18, and the hydraulic oil is supplied from the first actuator port 13 to the actuator 7 to operate the actuator 7. Then, the hydraulic oil is discharged from the actuator 7 to the second actuator port 14.

In this case, at the side where the first protrusion part 55*a* is disposed in the piston 55, the hydraulic oil in the first supply and discharge port 15 is activated. Thereby, the piston 55 moves from the state shown in FIG. 3 toward the second pilot check valve 19 within the hole for a path 62, and then, the second child valve for check 52 is pressed by the second protrusion part 55*b* to be opened so as to be communicated with the second through hole 50. Therefore, the pressure of the second back pressure chamber 46 is lowered, and due to the pressure of the second actuator port 14, the second main valve 44 is opened. As a result, the hydraulic oil discharged from the actuator 7 to the second actuator port 14 is further discharged to the second supply and discharge port 16. Then, the hydraulic oil discharged to the second supply and discharge port 16 will be discharged from the tank port 12*b* being communicated with the second supply and discharge port 16 to the tank 6.

Further, the hydraulic oil from the second actuator port 14 is supplied from the second throttle 48 of the second main valve 44 into the second back pressure chamber 46, and further, this hydraulic oil is activated on the second child valve for relief 57 through the second communicating path 66 of the second child valve for check 52. Therefore, when the pressure of the hydraulic oil from the second actuator port 14 exceeds a predetermined relief pressure, due to this pressure, the second child valve for relief 57 will be opened against the bias force of the second spring for relief 59. Thereby, the hydraulic oil is discharged through the tank port 12*b* via the second overload relief valve 32.

In this case, when the second child valve for relief 57 is further opened, the pressure of the second back pressure chamber 46 of the second main valve 44 will be lowered. Then, the pressure of the hydraulic oil activated from the second actuator port 14 on the second main valve 44 (the pressure of the hydraulic oil at the upstream side of the second throttle 48) is relatively higher than the pressure of the hydraulic oil of the second back pressure chamber 46, and this results in that the second main valve 44 is opened to be communicated with the second path 42. Thereby, when the pressure of the hydraulic oil from the second actuator port 14 exceeds a predetermined relief pressure, the hydraulic oil from the second actuator port 14 is discharged from the second overload relief valve 32 to the tank 6, and in addition to this, the hydraulic oil is discharged to the tank 6 through the second supply and discharge port 16 and the tank port 12*b* also via the second pilot check valve 19.

On the other hand, when the direction changing valve 17 is changed so that the spool 60 moves from the state shown in FIG. 3 (the state that the direction changing valve 17 is located at the neutral position 17*a*) to the direction represented by an arrow B shown in FIG. 3, the pump port 11 and the second supply and discharge port 16 will be communicated with each other via the notch part and the groove formed on the spool 60, and the first supply and discharge port 15 will be communicated with the tank port 12*a* (further, due to the changing operation that the spool 60 moves to the direction represented by the arrow B, the direction changing valve 17 is changed to the changing position 17*c* shown in FIG. 2). Thereby, the hydraulic oil supplied from the pump 5 to the pump port 11 will be supplied to the second supply and discharge port 16.

The hydraulic oil supplied from the pump port 11 to the second supply and discharge port 16 biases the second main valve 44 against the bias force of the second spring for check 54 of the second pilot check valve 19 so as to open the second main valve 44 in the forward direction. Thereby, the hydraulic oil is supplied from the second supply and discharge port 16 to the second actuator port 14 via the second pilot check valve 19, and the hydraulic oil is supplied from the second actuator port 14 to the actuator 7 to operate the actuator 7. Then, the hydraulic oil is discharged from the actuator 7 to the first actuator port 13.

In this case, at the side where the second protrusion part 55*b* is disposed in the piston 55, the hydraulic oil in the second supply and discharge port 16 is activated. Thereby, the piston 55 moves from the state shown in FIG. 3 toward the first pilot check valve 18 within the hole for a path 62, and then, the first child valve for check 51 is pressed by the first protrusion part 55*a* to be opened so as to be communicated with the first through hole 49. Therefore, the pressure of the first back pressure chamber 45 is lowered, and due to the pressure of the first actuator port 13, the first main valve 43 is opened. As a result, the hydraulic oil discharged from the actuator 7 to the first actuator port 13 is further discharged to the first supply and discharge port 15. Then, the hydraulic oil discharged to the first supply and discharge port 15 will be discharged from the tank port 12*a* being communicated with the first supply and discharge port 15 to the tank 6.

Further, the hydraulic oil from the first actuator port 13 is supplied from the first throttle 47 of the first main valve 43 into the first back pressure chamber 45, and further, this hydraulic oil is activated on the first child valve for relief 56 through the first communicating path 65. Therefore, when the pressure of the hydraulic oil from the first actuator port 13 exceeds a predetermined relief pressure, due to this pressure, the first child valve for relief 56 will be opened against the bias force of the first spring for relief 58. Thereby, the hydraulic oil is discharged through the tank port 12*a* via the first overload relief valve 31.

In this case, when the first child valve for relief 56 is further opened, the pressure of the first back pressure chamber 45 of the first main valve 43 will be lowered. Then, the pressure of the hydraulic oil activated from the first actuator port 13 on the first main valve 43 (the pressure of the hydraulic oil at the upstream side of the first throttle 47) is relatively higher than the pressure of the hydraulic oil of the first back pressure chamber 45, and this results in that the first main valve 43 is opened to be communicated with the first path 41. Thereby, when the pressure of the hydraulic oil from the first actuator port 13 exceeds a predetermined relief pressure, the hydraulic oil from the first actuator port 13 is discharged from the first overload relief valve 31 to the tank 6, and in addition to this, the hydraulic oil is discharged to the tank 6 through the first supply and discharge port 15 and the tank port 12*a* also via the first pilot check valve 18.

According to the valve gear 3 of the above-described present embodiment, it is possible to use the first main 43 as the main valves for the first overload relief valve 31 and the main valve for the first pilot check valve 18. This makes it possible to reduce the number of parts and to simplify the circuit structure in the valve gear. In addition, since the path to be communicated from the first overload relief valve 31 to the first actuator port 13 and the path to be communicated from the first pilot check valve 18 to the first actuator port 13 can be standardized, it is possible to simplify the path structure in the valve gear and to downsize the valve gear itself.

In addition, according to the valve gear 3, since the first child valve for relief 56 and the first child valve for check 51 can be arranged within the same and straight hole for a path 62, the number of processing steps of the hole in the valve gear can be reduced. Further, by arranging the first child valve for relief 56 and the first child valve for check 51 so that their operational directions are located on the same axis, both of the first pilot check valve 18 and the first overload relief valve 31 can be arranged at the substantially same space as the case that any one of the first pilot check valve 18 and the first overload relief valve 31 is arranged, and this makes it possible to prevent enlargement of the valve gear.

In addition, according to the valve gear 3, since the first child valve for relief 56, the first child valve for check 51, the second child valve for relief 57, and the second child valve for check 58 can be arranged within the same and straight hole for a path 62, the number of processing steps of the hole in the valve gear can be reduced.

The embodiments of the invention are described as above, however, the invention is not limited to these embodiments and various modifications are possible within a scope of the claims.

What is claimed is:

1. A hydraulic circuit comprising:

a pump port that is communicated with a pump;

a tank port that is communicated with a tank;

a first actuator port and a second actuator port that are communicated with an actuator;

a first supply and discharge port that is communicated with the first actuator port and a second supply and discharge port that is communicated with the second actuator port;

a direction changing valve that is arranged between the pump port and the tank port and between the first supply and discharge port and the second supply and discharge port, and changes a supply and discharge direction of a hydraulic oil between the pump, the tank, and the actuator;

a first pilot check valve that is arranged between the first supply and discharge port and the first actuator port;

a first pilot path that activates the pressure of the hydraulic oil from the second supply and discharge port on the first pilot check valve as the pilot pressure; and a first overload relief valve that discharge the excess amount of the hydraulic oil in the first actuator port;

wherein the direction changing valve has a neutral position to communicate the first supply and discharge port with the tank port;

wherein the first overload relief valve is arranged in parallel with the first pilot check valve and is arranged between the first supply and discharge port and the first actuator port; and wherein the first overload relief valve serves as first valve opening means that opens the first pilot check valve when the pressure of the hydraulic oil from the first actuator port exceeds a predetermined relief pressure.

2. A valve gear comprising:

a main body on which a pump port communicated with a pump; a tank port communicated with a tank; a first actuator port and a second actuator port communicated with an actuator; and a first supply and discharge port that is communicated with the first actuator port and a second supply and discharge port that is communicated with the second actuator port are formed;

a direction changing valve that is arranged in the main body between the pump port and the tank port and between the first supply and discharge port and the second supply and discharge port, and changes a supply and discharge direction of a hydraulic oil between the pump, the tank, and the actuator;

a first path formed on the main body so as to communicate the first supply and discharge port with the first actuator port;

a first main valve that is arranged so as to be capable of communicating and interrupting the first path;

a first back pressure chamber that is formed on the first main valve;

a first throttle that is formed on the first main valve and communicates the first back pressure chamber with the first actuator port;

a first through hole that is formed on the first main valve and communicates the first back pressure chamber with the first supply and discharge port;

a first child valve for check that is arranged so as to be capable of communicating and interrupting the first through hole;

a first spring for check that biases the first child valve for check toward a direction to interrupt the first through hole; and a piston that is arranged being capable of pressing the first child valve for check in a valve opening direction so as to be communicated with the first through hole by activation of the pressure of the hydraulic oil in the second supply and discharge port;

wherein the valve gear further comprising:

a first child valve for relief that is arranged so as to be capable of communicating and interrupting the space between the first back pressure chamber and the tank port; and a first spring for relief that is arranged to be stretched against the pressure of the hydraulic oil from the first actuator port so as to bias the first child valve for relief in a direction interrupting the space between the first back pressure chamber and the tank port;

wherein, when the pressure of the hydraulic oil from the first actuator port exceeds a predetermined relief pressure, due to the activation of the pressure of the hydraulic oil from the first actuator port, the first child valve for relief is opened against the bias force of the first spring for relief so as to lower the pressure of the hydraulic oil in the first back pressure chamber, and the first main valve is opened so as to be communicated with the first path.

3. The valve gear according to claim 2, wherein the first child valve for relief and the first child valve for check are arranged so that their operational directions are located on the same axis.

4. The valve gear according to claim 3, further comprising:

a second path formed on the main body so as to communicate the second supply and discharge port with the second actuator port;

a second main valve that is arranged so as to be capable of communicating and interrupting the second path;

a second back pressure chamber that is formed on the second main valve;

a second throttle that is formed on the second main valve and communicates the second back pressure chamber with the second actuator port;

a second through hole that is formed on the second main valve and communicates the second back pressure chamber with the second supply and discharge port;

a second child valve for check that is arranged so as to be capable of communicating and interrupting the second through hole;

a second spring for check that biases the second child valve for check toward a direction to interrupt the second through hole;

a piston that is arranged being capable of pressing the second child valve for check in a valve opening direction so as to be communicated with the second through hole by activation of the pressure of the hydraulic oil in the first supply and discharge port;

a second child valve for relief that is arranged so as to be capable of communicating and interrupting the space between the second back pressure chamber and the tank port; and a second spring for relief that is arranged to be stretched against the pressure of the hydraulic oil from the second actuator port so as to bias the second child valve for relief in a direction interrupting the space between the second back pressure chamber and the tank port;

wherein the second child valve for relief and the second child valve for check are arranged so that their operational directions are located on the same axis as the operational direction of the first child valve for relief, and when the pressure of the hydraulic oil from the second actuator port exceeds a predetermined relief pressure, due to the activation of the pressure of the hydraulic oil from the second actuator port, the second child valve for relief is opened against the bias force of the second spring for relief so as to lower the pressure of the hydraulic oil in the second back pressure chamber, and the second main valve is opened so as to be communicated with the second path.

* * * * *